US011946486B2

(12) United States Patent
Loercher

(10) Patent No.: US 11,946,486 B2
(45) Date of Patent: Apr. 2, 2024

(54) FAN WITH SCROLL HOUSING AND SCROLL HOUSING FOR FAN

(71) Applicant: ZIEHL-ABEGG SE, Künzelsau (DE)

(72) Inventor: Frieder Loercher, Braunsbach (DE)

(73) Assignee: ZIEHL-ABEGG SE, Kunzelsau (DE)

( * ) Notice: Subject to any disclaimer, the term of this patent is extended or adjusted under 35 U.S.C. 154(b) by 93 days.

(21) Appl. No.: 17/625,555

(22) PCT Filed: Jun. 17, 2020

(86) PCT No.: PCT/DE2020/200049

§ 371 (c)(1),
(2) Date: Jan. 7, 2022

(87) PCT Pub. No.: WO2021/004589

PCT Pub. Date: Jan. 14, 2021

(65) Prior Publication Data

US 2022/0290688 A1 Sep. 15, 2022

(30) Foreign Application Priority Data

Jul. 9, 2019 (DE) ..... 10 2019 210 077.5

(51) Int. Cl.
*F04D 29/42* (2006.01)

(52) U.S. Cl.
CPC ..... *F04D 29/4226* (2013.01); *F04D 29/422* (2013.01)

(58) Field of Classification Search
CPC ..... F04D 29/422; F04D 29/4226
See application file for complete search history.

(56) References Cited

U.S. PATENT DOCUMENTS 662,395 A * 11/1900 Davidson ..... F04D 29/4226 55/400
801,304 A * 10/1905 Davidson ..... F04D 29/4226 415/53.1
3,561,885 A * 2/1971 Lake ..... F04D 29/4226 415/214.1
5,419,680 A * 5/1995 Asano ..... F04D 29/422 415/119
5,474,422 A 12/1995 Sullivan
7,311,492 B2 * 12/2007 Ostberg ..... F04D 29/4226 415/126
2009/0232648 A1 9/2009 Wu
2020/0063748 A1 * 2/2020 Manz ..... F04D 29/4226

FOREIGN PATENT DOCUMENTS

CN 1756908 4/2006
CN 102317633 1/2012
CN 102758795 A 10/2012
CN 105386996 3/2016

(Continued)

*Primary Examiner* — Justin D Seabe
(74) *Attorney, Agent, or Firm* — FisherBroyles, LLP; Jason P. Mueller

(57) ABSTRACT

A fan with an impeller having, in an embodiment, backward-curved blades and having a scroll housing, the flow channel of which is formed by an inner spiral contour of the housing, the flow channel guiding the air conveyed by the impeller towards an outlet wherein the spiral contour with its local pitch angles is adapted to the outlet angle from the impeller.

16 Claims, 7 Drawing Sheets

(56) References Cited

FOREIGN PATENT DOCUMENTS

| | | | |
|---|---|---|---|
| DE | 102005012815 | | 10/2005 |
| EP | 3333431 | | 6/2018 |
| JP | H0274599 | U | 6/1990 |
| JP | 2011149328 | A | 8/2011 |
| WO | 2009143920 | A1 | 12/2009 |
| WO | 2017106530 | A1 | 6/2017 |

* cited by examiner

FAN WITH SCROLL HOUSING AND SCROLL HOUSING FOR FAN

CROSS-REFERENCE TO RELATED APPLICATIONS

This application is a national stage entry application under 35 U.S.C. 371 of PCT Patent Application No. PCT/DE2020/200049, filed 17 Jun. 2020, which claims priority to German Patent Application No. 10 2019 210 077.5, filed 9 Jul. 2019, the entire contents of each of which are incorporated herein by reference.

FIELD

The present disclosure relates to a fan with an impeller having, in an embodiment, backward-curved blades and having a scroll housing, the flow channel of which is formed by an inner spiral contour of the housing, the flow channel guiding the air conveyed by the impeller towards an outlet. The disclosure also relates to a scroll housing for a fan.

BACKGROUND

Fans with scroll housings are widely used, especially for forward-curved radial and diagonal fans. Increasingly, scroll housings are also being used for backward-curved fans. Practical experience has shown that the use of a scroll housing results in an additional increase in pressure and an associated increase in static efficiency. Scroll housings are suitable for efficiently directing the discharging air downstream of the fan impeller into a flow channel running approximately orthogonally to the fan axis, for example into a tube with a round or square cross section.

In the case of backward-curved impellers, there is usually a rather small increase in efficiency, since the outflow angles tend to be steeper (namely more strongly oriented in the radial direction) than in the case of forward-curved impellers. Especially in the region of the flow channel with the smallest flow cross section, i.e. In the region of the tongue, the outflowing air of backward-curved fans has a strong angle of attack to the housing contour, which is fundamentally bad for the static efficiency and the low noise.

Reference is made with regard to the prior art in printed publications only by way of example to DE 10 2005 012 815 A1. This publication describes a radial blower in a scroll housing in which the circumferential wall of the housing widens radially from the nozzle wall to the wall on the circular base side. The housing is designed for a forward-curved impeller. Possible optimizations with regard to a more or less steep course of the inner contour are unknown from this publication.

SUMMARY

It is the object of the present disclosure to design the generic fan with a scroll housing in such a way that it is also suitable in particular for impellers with backward-curved blades. In particular, higher efficiency and better acoustics are to be achieved for radial or diagonal fans with backward-curved impellers.

Furthermore, the housing should be compact. In addition, the housing should be simple in design and therefore inexpensive to manufacture.

The above object is achieved with respect to the fan by the features of claim 1 and with respect to the scroll housing by the features of claim 15. According to this, the spiral contour of the scroll housing with its local pitch angles, e.g., in the course of the flow channel, is adapted to the outlet angle from the impeller.

According to the present disclosure, it has been identified that the spiral contour with its local pitch angles is of particular importance with regard to efficiency and noise. Thus, according to the disclosure, the spiral contour is adapted to the outlet angle from the impeller, and this with a compact design.

The development of the fan according to the disclosure and the scroll housing used therein relates in an embodiment to backward-curved radial or diagonal fans with an adapted inner contour. The local pitch angle of the spiral contour, approximately viewed in the direction of rotation of the impeller, extends from a narrowest region in the flow channel, located near or at a tongue, starting with a larger value than in the further course up to an outlet with an outlet contour remote from the tongue. The initially large pitch angle is rapidly reduced again to lower values in the further course of the flow channel in the circumferential direction, in an embodiment to also ensure the compactness of the scroll housing.

Typically, the local pitch angle of the inner contour of the scroll housing, especially over a sector range of approx. 24° to 55°, starting from the narrowest region of the flow channel or from the tongue, has on average significantly higher values than in the further course of the flow channel after the sector region.

There are several possibilities for defining specific points and regions in the flow channel in the light of the features according to the present disclosure. For example, the beginning of the spiral contour near the tongue can be defined as the point on the inner contour of the housing which is closest to the impeller axis or at which, moving from the tongue in the direction of rotation of the impeller, the curvature of the inner contour reverses its sign. The radius of the circle of curvature is small at the beginning or starting point of the spiral contour, namely in the narrowest region of the flow channel, in comparison to the course of the radius of the circle of curvature over a large part of the course of the spiral contour. The radius of the circle of curvature of the spiral contour is, in an embodiment, minimal towards the beginning of the spiral contour.

In a further embodiment, the radius of the circle of curvature at the starting point of the spiral contour is at least slightly smaller than the maximum radius of the impeller. For example, the radius of the circle of curvature at the starting point is smaller than in the prior art, the spiral contour there regularly having a logarithmic spiral. This results in a particularly high efficiency and a particularly low noise emission for the scroll housing according to the disclosure for backward-curved impellers.

Between the tongue and the largest radius of the impeller or the blades of the impeller there is, in a further embodiment, a distance of at least 6% or 10% of the maximum radius of the impeller, which is particularly advantageous for low noise level.

With regard to a simple construction of the housing, it is advantageous if the housing essentially consists of two housing halves, one housing half on the side of the inflow nozzle including the inflow nozzle and optionally an inflow area upstream of the inflow nozzle with a larger outer radius than the inflow nozzle. One housing half on the motor side including mounting means for the motor with a stator. The two housing halves can be made from injection-molded plastic.

In the light of the above explanations, it becomes clear that the two housing halves not only form the housing itself, but also functional parts, namely, for example, the integrated inlet nozzle, through which the ambient air flows into the impeller during fan operation. The same applies to the upstream inflow area with a larger outer radius than the inflow nozzle. The inflow area radially outside the inlet nozzle is, in an embodiment, designed as a planar or flat surface, the outer radius of which can be, for example, 35% larger than the largest radius (outer radius) of the inlet nozzle.

Fastening means for the motor with a stator are provided on the motor-side housing half, which can also be integrated there.

The two housing halves are, in an embodiment, connected to each other in a flange-like connecting region, the flange possibly being equipped with holes for screw connection. It is also conceivable to connect the two housing halves by clipping, riveting or glueing.

In the area around the outlet from the spiral housing through which the air conveyed through the flow channel exits, a fastening flange can be formed directly on the housing halves, on which the entire fan, for example, on a surrounding structure, namely on a ventilation system, an air channel, etc. is attached. Holes can also be provided in there so that the fastening can be done by screwing.

Since considerable overpressures can occur inside the fan during operation, especially inside the flow channel, compared to the surroundings, it is of further advantage to provide the two housing halves with stiffening elements, for example with stiffening ribs. This achieves greater dimensional stability that can withstand the high pressures, and in particular any pressure fluctuations.

As an alternative to the previously discussed housing structure, it is conceivable that the scroll housing comprises a substantially flat or planar lateral part on the motor side, a substantially flat or planar lateral part on the inlet nozzle side and an unwindable peripheral part, the parts being made of sheet metal, in an embodiment. Accordingly, the lateral parts are lateral sheet metal parts. The peripheral part can correspondingly be designed as an unwindable scroll sheet metal which forms the inner contour of the flow channel.

An inspection opening with a closable cover can be provided in the motor-side lateral part to facilitate access to the motor and the impeller. An inlet nozzle can be integrated in the nozzle-side lateral part, a one-piece embodiment or an embodiment of the inlet nozzle as a separate sheet metal or plastic part being conceivable. A square or rectangular air outlet, for example, can be formed by the lateral parts. For additional reinforcement, it is conceivable to provide a further reinforcing sheet metal part having the function of a fastening flange and to fasten it to the lateral parts on the outflow side. As in the exemplary embodiment discussed above, the fastening flange serves to fasten the fan to a superordinate system, for example an air conditioning system or an external flow channel.

There are now various possibilities for advantageously designing and further developing the teaching of the present disclosure. For this purpose, reference should be made on the one hand to the claims subordinate to claim 1 and on the other hand to the following explanation of exemplary embodiments of a fan according to the disclosure with reference to drawings. In connection with the explanation of the exemplary embodiments of the disclosure with reference to drawings, embodiments and developments of the teachings are also explained in general.

DETAILED DESCRIPTION OF THE DISCLOSURE

Figure 1:
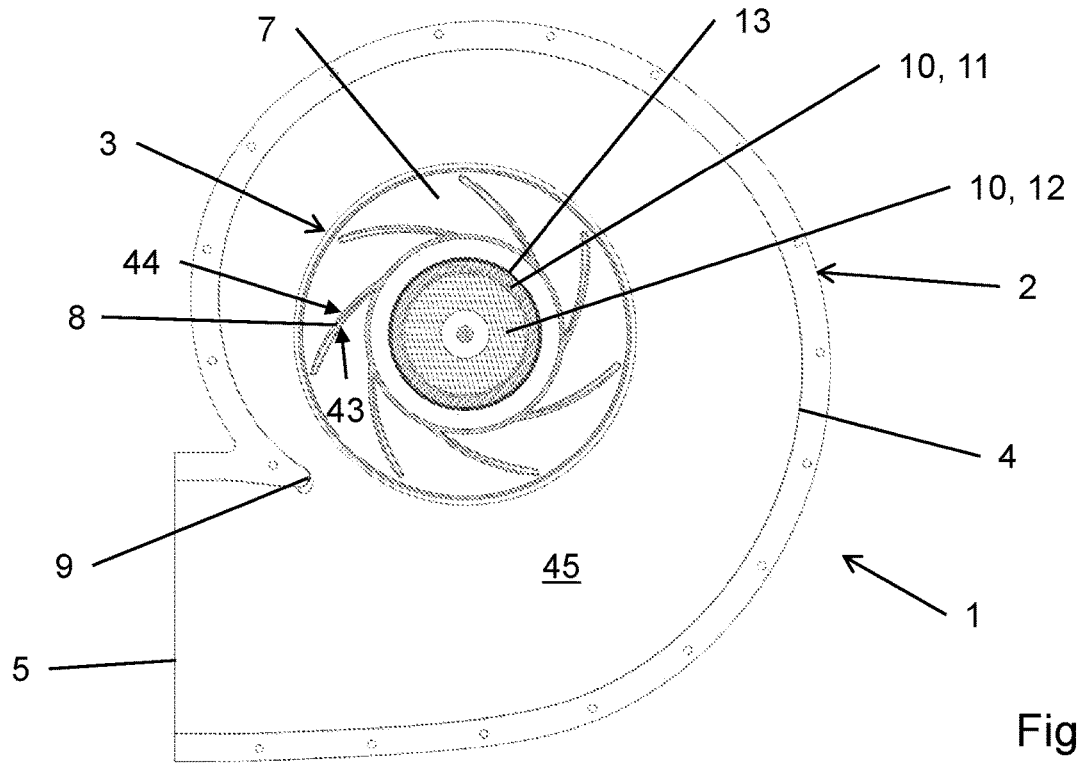
FIG. 1 shows a fan with a scroll housing viewed in the direction of the impeller axis and in a section on a plane transverse to the impeller axis.

FIG. 1 shows a fan 1 with a scroll housing 2 viewed in the direction of the impeller axis and in a section on a plane transverse to the impeller axis. The scroll housing 2 in the exemplary embodiment is composed of 2 halves (see also FIG. 2), the section shown here running exactly through the, in this case, planar joint face of the two halves. The planar section running perpendicular to the fan axis runs at the position, seen in the direction of the axis, at which the surface enclosed by the inner contour 4 of the scroll housing 2 and the outlet 5 is approximately at a maximum.

In addition to the scroll housing 2, the fan also includes a motor 10 with rotor 11 and stator 12, which are only shown schematically in section. Furthermore, the fan comprises an impeller 3 consisting of a circular base 7, a cover disc not shown due to the section, and blades 8 extending therebetween. The impeller 3, which is may be made from injection-molded plastic, is fastened at its circular base 7 in the exemplary embodiment by means of a circular sheet metal blank 13 to the rotor 11 of the drive motor 10. The impeller 3 rotates in operation, seen in this view, clockwise. It is accordingly a backward-curved impeller 3, e.g. an impeller 3 with backward-curved blades 8. In the case of backward-curved impellers 3, the blade pressure side 44 of a blade 8, which precedes the blade suction side 43 of the same blade 8 in the direction of rotation of the impeller 3 during operation, is convex, while the blade suction side 43 is concave. The blades 8 are curved in the opposite direction to the direction of rotation, especially when considering the course of the blades 8 from radially inward (from the leading edge) to radially outward (towards the trailing edge).

When the fan is in operation, the conveyed air exits radially outwardly from the impeller 3 into the flow channel 45 of the scroll housing 2, which extends substantially in the circumferential direction with respect to the impeller axis. From a narrowest point in the region of the tongue 9, the flow channel 45 widens in its course in the circumferential direction in order to accommodate the air flow increasing in the circumferential direction, towards an outlet 5 from the scroll housing 2. Of importance to the disclosure is the design and the course of the inner contour 4, which decisively influences the efficiency and the acoustics of the fan. This course and its relevant features are described further in FIG. 5 to FIG. 8 for the exemplary embodiment shown.

Figure 2:
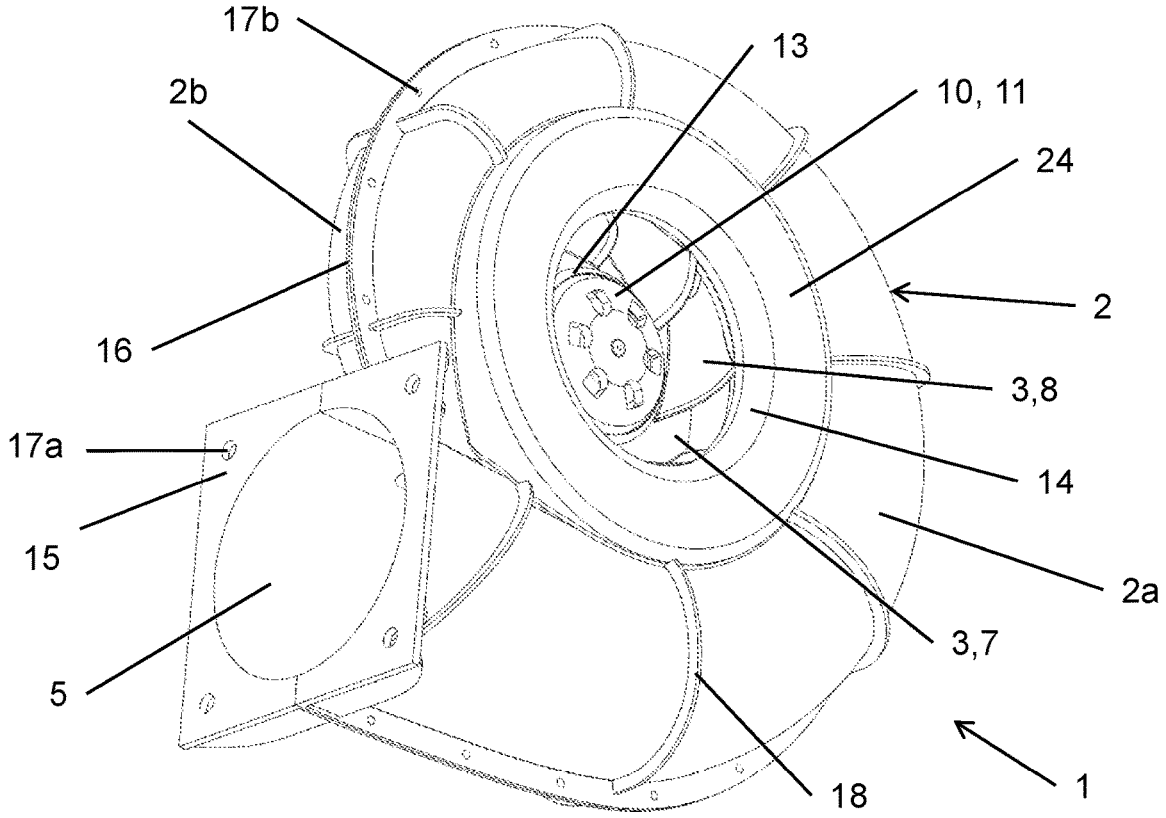
FIG. 2 shows the fan with the scroll housing according to FIG. 1 in a perspective view of the inlet nozzle and the outlet.

FIG. 2 shows a perspective view of the inlet nozzle 14 and the outlet 5 of the fan 1 with the scroll housing 2 according to FIG. 1. The structure of the scroll housing 2 in this embodiment, substantially includes two halves 2*a* and 2*b*, is clearly visible. These halves 2*a*, 2*b* may be made from injection-molded plastic. The inlet nozzle 14, through which the ambient air flows into the impeller 3 during fan operation, is integrated in the nozzle-side half 2*a*. Parts of the impeller 3 (blades 8 and circular base 7) as well as the rotor 11 of the motor 10, on which the impeller 3 is mounted, can be seen through the inlet nozzle 14 in the illustration shown. In an embodiment, a flat inflow area 24 is also formed radially outside the inflow nozzle 14 on the inflow side, the outer radius of which is at least 35% larger than the largest radius of the inflow nozzle 14 with respect to the fan axis.

On the motor-side half 2*b*, the motor 10 with its stator 12 is fastened to corresponding fastening devices integrated on the motor-side half 2*b*. The two halves 2*a* and 2*b* are mutually connected in a connecting region 16. In the exemplary embodiment, a type of flange is shown with holes 17*b*, at which the halves 2*a* and 2*b* can be mutually connected by screws. Other types of connection are also conceivable, for example, by clipping, riveting and/or glueing.

A fastening flange 15 is formed in the region around the outlet 5 from the scroll housing 2, through which the air exits and flows into a correspondingly shaped duct. By means of this flange, the entire fan 1 is fastened to a surrounding structure, for example an air conditioning system or an air duct. In the exemplary embodiment, the holes 17*a*, to which screws can be attached, are used for this purpose. Since considerable overpressures can occur during operation in the interior of the scroll housing 2, in its flow channel 45, compared to the external environment, the two halves 2*a* and 2*b* are provided with stiffening elements 18, in this case stiffening ribs 18, for better dimensional stability.

Figure 3:
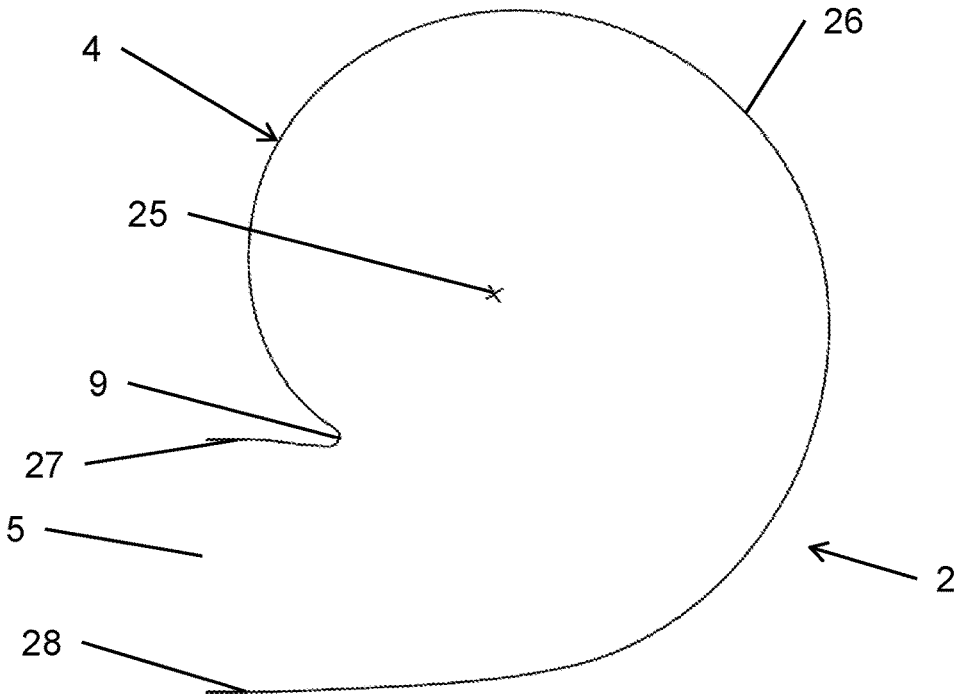
FIG. 3 shows the course of the inner contour of the scroll housing in FIG. 1 and FIG. 2 in a schematic illustration with a viewing direction corresponding to that of FIG. 1, seen in a section transverse to the impeller axis.

FIG. 3 shows the course of the inner contour 4 of the scroll housing 2 in FIG. 1 and FIG. 2 in a schematic illustration with a viewing direction corresponding to that of FIG. 1, viewed in a section transverse to the impeller axis. A representative section perpendicular to the impeller axis 25 is observable, for example at the point, seen in the axial direction, at which the region enclosed by the inner contour 4 and the outlet 5 is at a maximum, or at the level of the center of the impeller outlet or approximately in the center of the flow channel 45. In the schematic illustration shown, the inner contour 4 can be seen enclosing an outlet 5 at which the inner contour 4 is open. It can be subdivided into an outlet contour 27 on the tongue side, a tongue 9, a spiral contour 26 extending approximately around the impeller axis 25, and an outlet contour 28 remote from the tongue.

Figure 4:
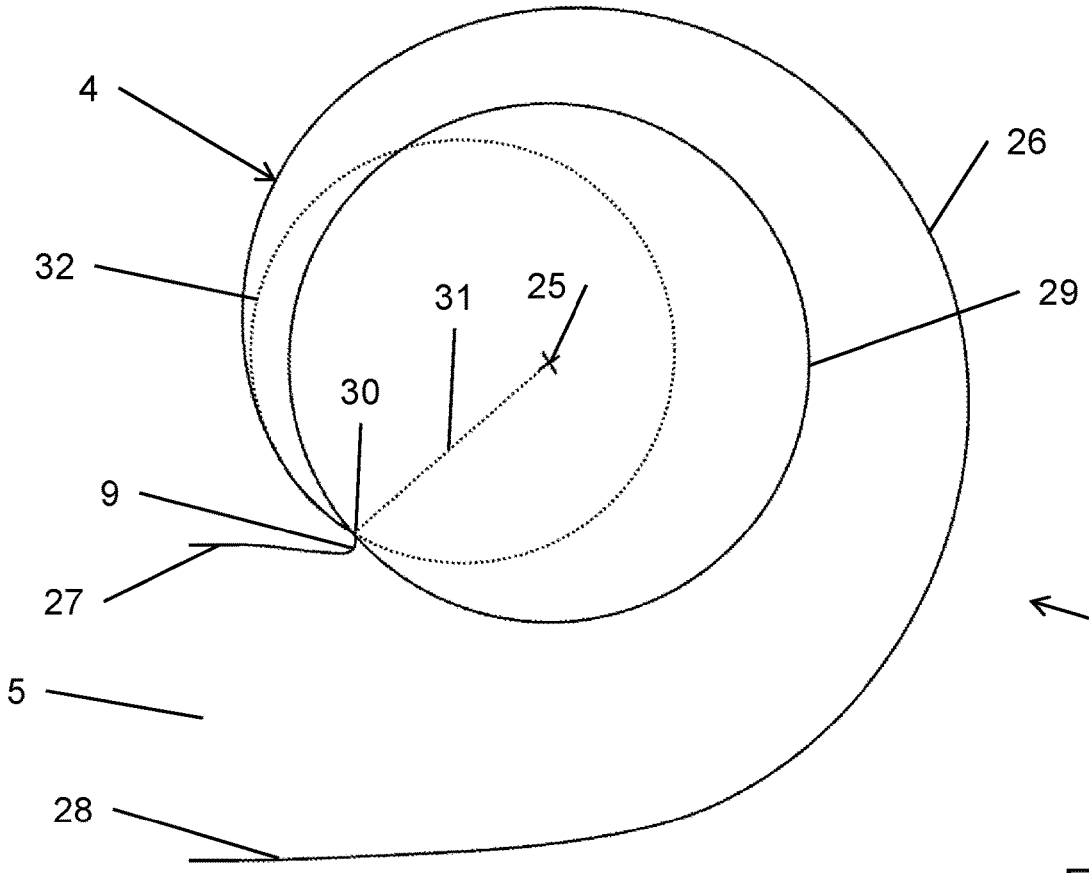
FIG. 4 shows the illustration according to FIG. 3, additionally plotting the largest inner circle coaxial to the impeller and the circle of curvature at the starting point of the spiral contour near the tongue.

FIG. 4 shows the illustration according to FIG. 3, additionally plotting the largest inner circle 29 coaxial to the impeller as well as the circle of curvature 32 of the spiral contour 26 at the starting point 30 near the tongue. The starting point 30 of the spiral contour 26 near the tongue can be defined as the point of the inner contour which is closest to the impeller axis 25, or as the point at which, moving from the tongue 9 in the direction of rotation of the impeller 3, the curvature of the inner contour 4 reverses its sign. The radius of the circle of curvature 32 at the starting point of the spiral contour 26 is, in an embodiment, small in comparison with the course of the radius of the circle of curvature over a large part of the course of the spiral contour 26. In an embodiment, the radius of the circle of curvature of the spiral contour 26 at the starting point 30 is minimal.

Figure 5:
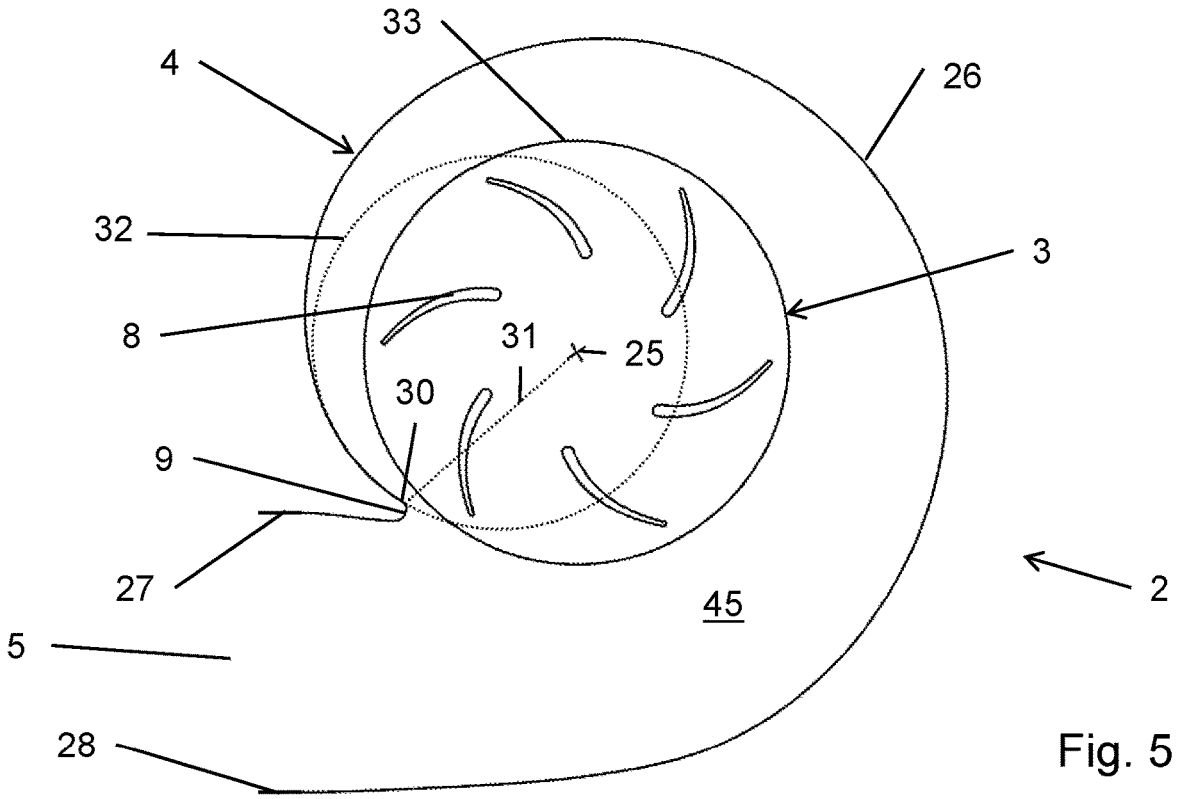
FIG. 5 shows the illustration according to FIG. 3, additionally plotting a schematic section through the impeller and the circle of curvature at the start of the spiral contour near the tongue.

FIG. 5 shows, similar to FIG. 4, the illustration according to FIG. 3, additionally plotting a schematic drawing of a section through the impeller 3 and the circle of curvature 32 of the spiral contour 26 at the starting point 30 near the tongue. In the exemplary embodiment, the radius of the circle of curvature 32 at the starting point of the spiral contour 26 is smaller than the maximum radius 33 of the impeller 3, e.g. this radius of curvature 32 at the starting point 30 is smaller than in the known prior art with a spiral contour, for example a logarithmic spiral. This results in a particularly high efficiency and a particularly low noise emission for the scroll housing 2 for backward-curved impellers. There is a distance between the tongue 9 and the largest radius 33 of the impeller 3 and the blades 8 of the impeller 3 of at least 6% or 10% of the maximum radius 33 of the impeller 3, which is advantageous for low noise emission.

Figure 6:
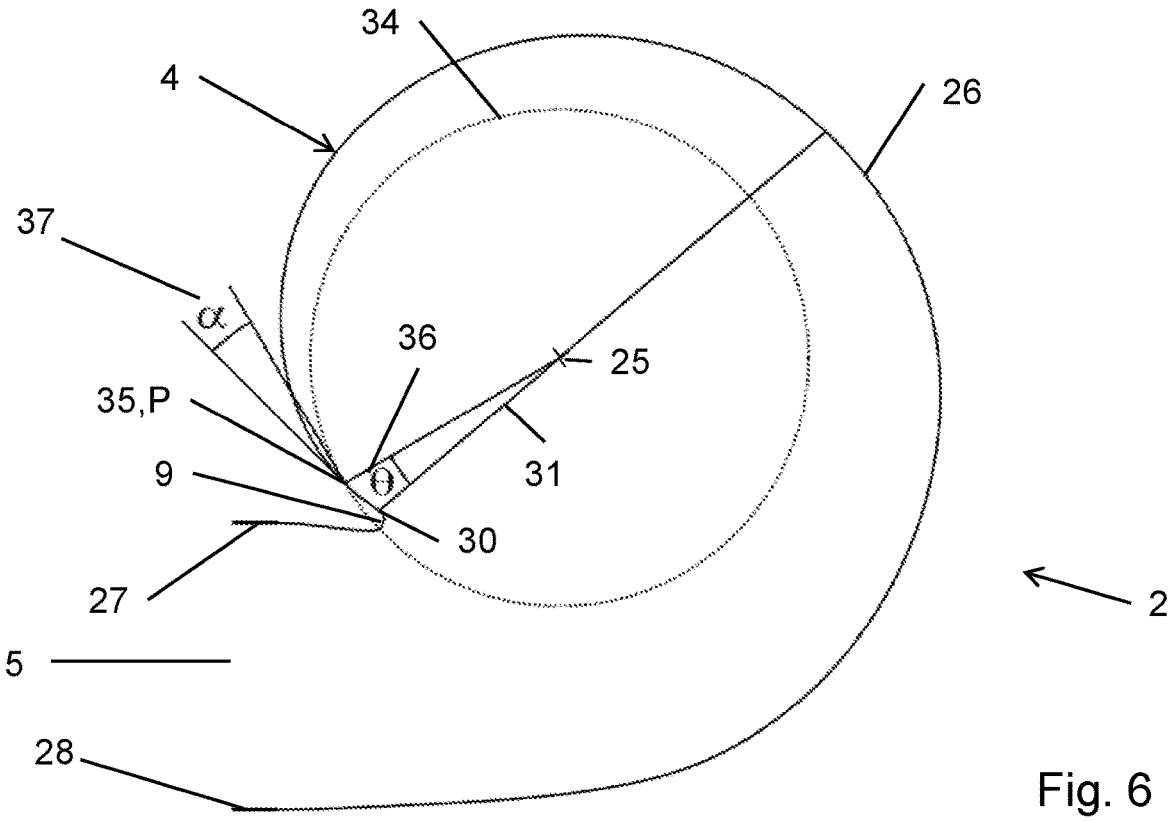
FIG. 6 shows the illustration according to FIG. 3, additionally plotting the azimuthal angle $\theta$ of a point on the inner contour as well as the determination of the corresponding local pitch angle $\alpha$ of the inner contour.

FIG. 6 shows, similar to FIG. 4 and FIG. 5, the illustration according to FIG. 3, additionally plotting the azimuthal angle θ (36) of a ppoint P (35) on the spiral contour 26 as well as the determination of the associated local pitch angle α (37) of the spiral contour 26. The position of a point P (35) on a spiral contour 26 is determined by the azimuthal angle θ (36). This is the angle between the distance from the impeller axis 25 to the point P (35) and the reference beam 31, which connects the impeller axis 25 with the starting point 30 of the spiral contour 26. At each point P (35), the angle α (37) between the circumferential direction (the tangent to a circle 34 coaxial with the impeller through p (35)) and the spiral contour 26 or its local tangent to p (35) can be defined. The course of this angle α (37) is decisive for achieving a high efficiency and low noise levels. In an embodiment, it is to be considered in a range for θ (36) from 0° to 180°, the course near the tongue 9 being especially decisive. In addition to the course of a (37) in the range for θ (36) from 0° to 180°, the course of the distance r of the spiral contour 26 from the impeller axis 25 can also be considered in the range, or the course of the curvature κ, κ being the reciprocal of the local radius of curvature at a point P (35) at a certain θ (36). The spiral contour 26 can be characterized with these courses, and FIGS. 11 to 13 show typical courses for scroll housings according to the disclosure.

Figure 11:
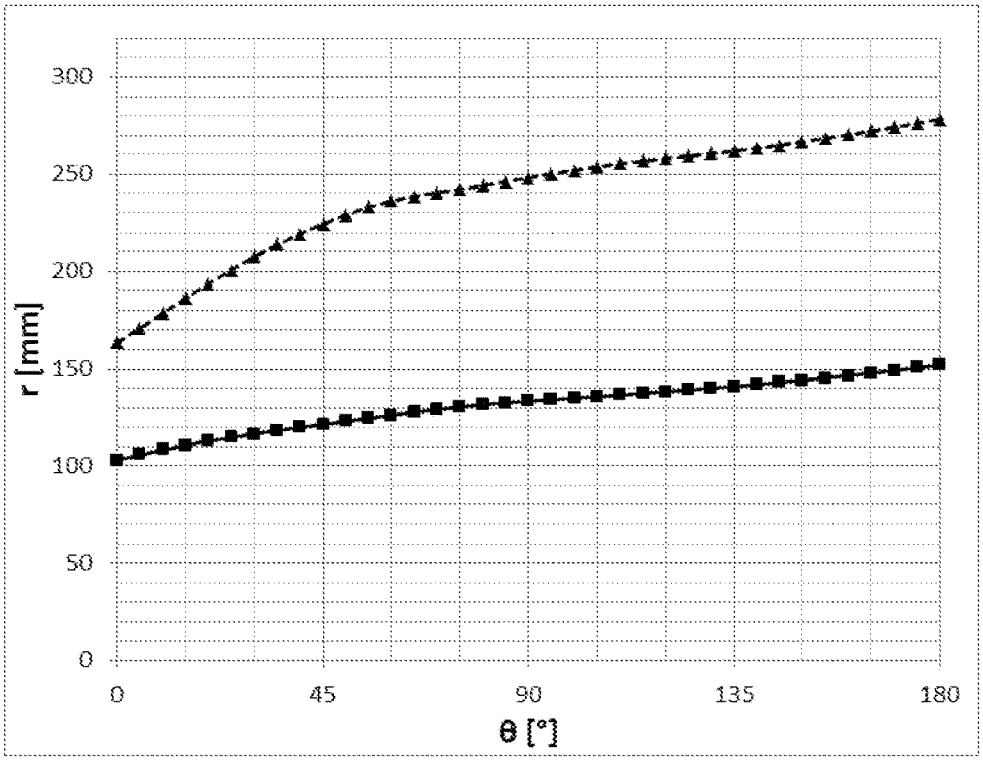
FIG. 11 shows two typical courses of the distance of the spiral contour from the impeller axis in spiral housings in a diagram.

FIG. 11 shows a diagram depicting two typical courses of the distance r of a spiral contour 26 from the impeller axis 25 in scroll housings according to the disclosure. The distance r has, for both courses shown, the smallest value at the starting point 30 of the spiral contour 26 at the tongue 9 and increases substantially in the course of the spiral contour 26 at least up to θ=180°. In an embodiment, it increases relatively sharply in the sector range from θ=0° to θ=45°. For example, for the contour represented by the curve with the triangular symbols, it increases by 61 mm in the range from θ=0° to θ=45° from 163 mm to 224 mm, which corresponds to an increase rate averaged in this range of 1.36 mm/1°, while increasing by 54 mm in the range from θ=45° to θ=180° from 224 mm to 278 mm, which corresponds to an increase rate averaged in this range of 0.4 mm/1°. That is, the average increase rate of the radius with respect to the azimuthal angle θ is more than three times higher in the sector range from θ=0° to θ=45° than in the range from θ=45° to θ=180°.

In the second example, the radius for the contour represented by the curve with the square symbols increases by 19 mm in the range from θ=0° to θ=45° from 103 mm to 122 mm, which corresponds to an increase rate averaged in this range of 0.42 mm/°, while increasing by 20 mm in the range from θ=45° to θ=180° from 122 mm to 152 mm, which corresponds to an increase rate averaged in this range of 0.22 mm/°. That is, the average increase rate of the radius with respect to the azimuthal angle θ is more than 1.5 times higher in the sector range from θ=0° to θ=45° than in the range from θ=45° to θ=180°.

Figure 12:
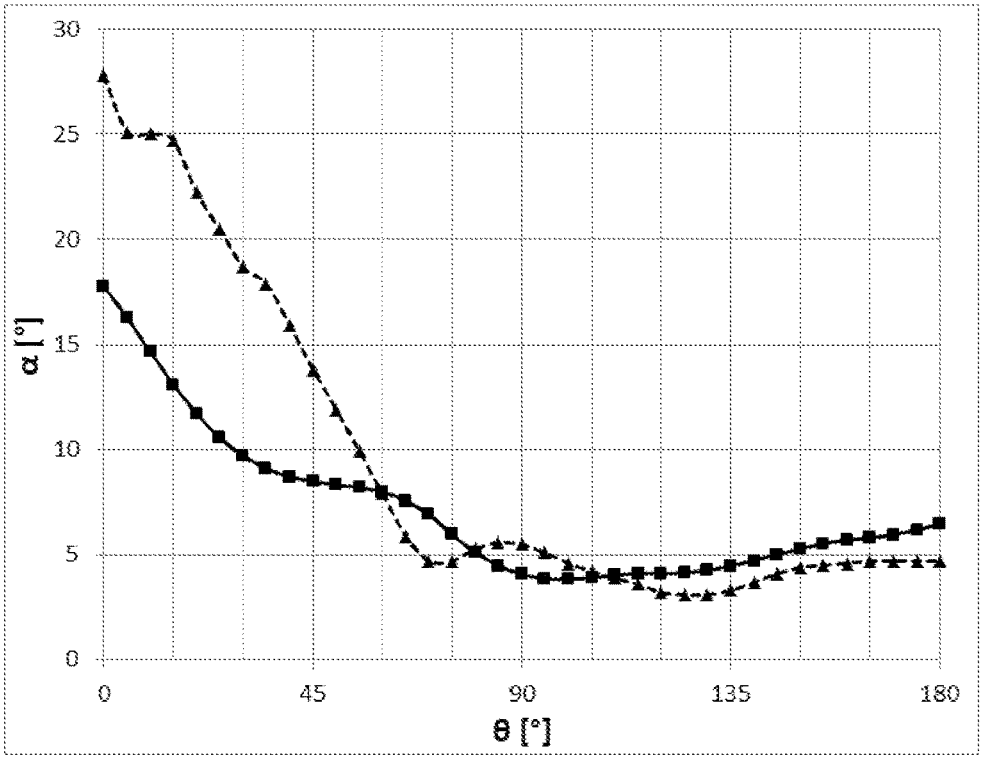
FIG. 12 shows a diagram of two typical courses of pitch angle $\alpha$ of the spiral contour in spiral housings.
Figure 13:
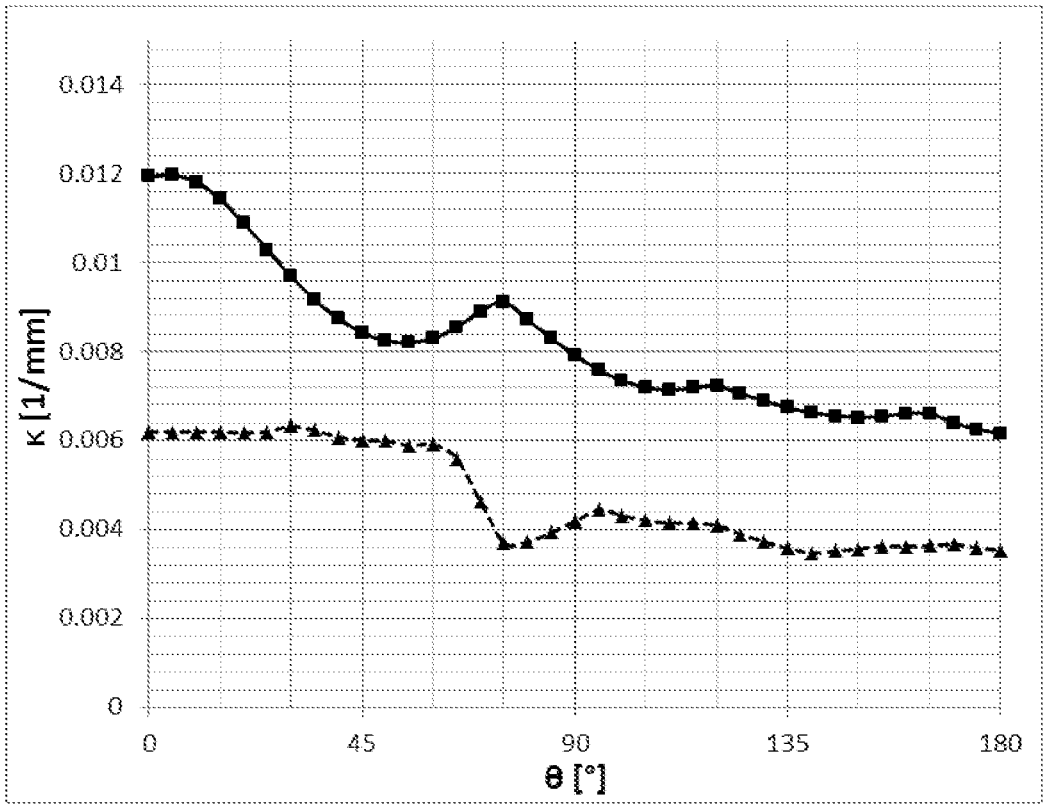
FIG. 13 shows a diagram of two typical courses of curvature $\kappa$ of the spiral contour in spiral housings.

FIG. 12 shows a diagram depicting two typical courses of the pitch angle α of the spiral contour 26 in scroll housings according to the disclosure. Both courses have relatively high pitch angles α in a sector range from θ=0° to θ=45°. For example, for the spiral contour represented by the curve with the triangular symbols, the pitch angle α has an average value of about 21° in the interval from θ=0° to θ=45°, while having an average value of about 5.5° in the interval from θ=45° to θ=180°. That is, the average pitch angle α of the spiral contour 26 is more than three times higher in the sector range from θ=0° to θ=45° than in the range from θ=45° to θ=180°.

In the second example, the pitch angle α for the spiral contour represented by the curve with the square symbols has an average value of about 12° in the interval from θ=0° to θ=45°, while having an average value of about 5.5° in the interval from θ=45° to θ=180°. That is, the average pitch angle α of the spiral contour 26 is more than twice as high in the sector range from θ=0° to θ=45° as in the range from θ=45° to θ=180°.

FIG. 13 shows a diagram depicting two typical courses of the curvature κ of a spiral contour 26 in scroll housings according to the disclosure. Both courses have relatively high curvatures κ in a sector range from θ=0° to θ=45°. For example, the curvature κ for the contour represented by the curve with the triangular symbols has an average value of about 0.0062 l/mm in the interval from θ=0° to θ=45°, while having an average value of about 0.0042 l/mm in the interval from θ=45° to θ=180°. That is, the average curvature κ of the spiral contour 26 is more than 35% higher in the sector range from θ=0° to θ=45° than in the range from θ=45° to θ=180°.

In the second example, the curvature κ for the contour represented by the curve with the square symbols has an average value of about 0.01 l/mm in the interval from θ=0° to θ=45°, while it has an average value of about 0.0074 l/mm in the interval from θ=45° to θ=180°. That is, the average curvature κ of the spiral contour 26 is more than 30% higher in the sector range from θ=0° to θ=45° compared to the range from θ=45° to θ=180°.

It should also be noted that in the preceding descriptions of FIGS. 11 to 13, a sector range of θ=0° to θ=45° was always selected as an example. Likewise, in other embodiments, another sector range can also be selected between the sector ranges from θ=0° to θ=24° and θ=0° to θ=55°.

Figure 7:
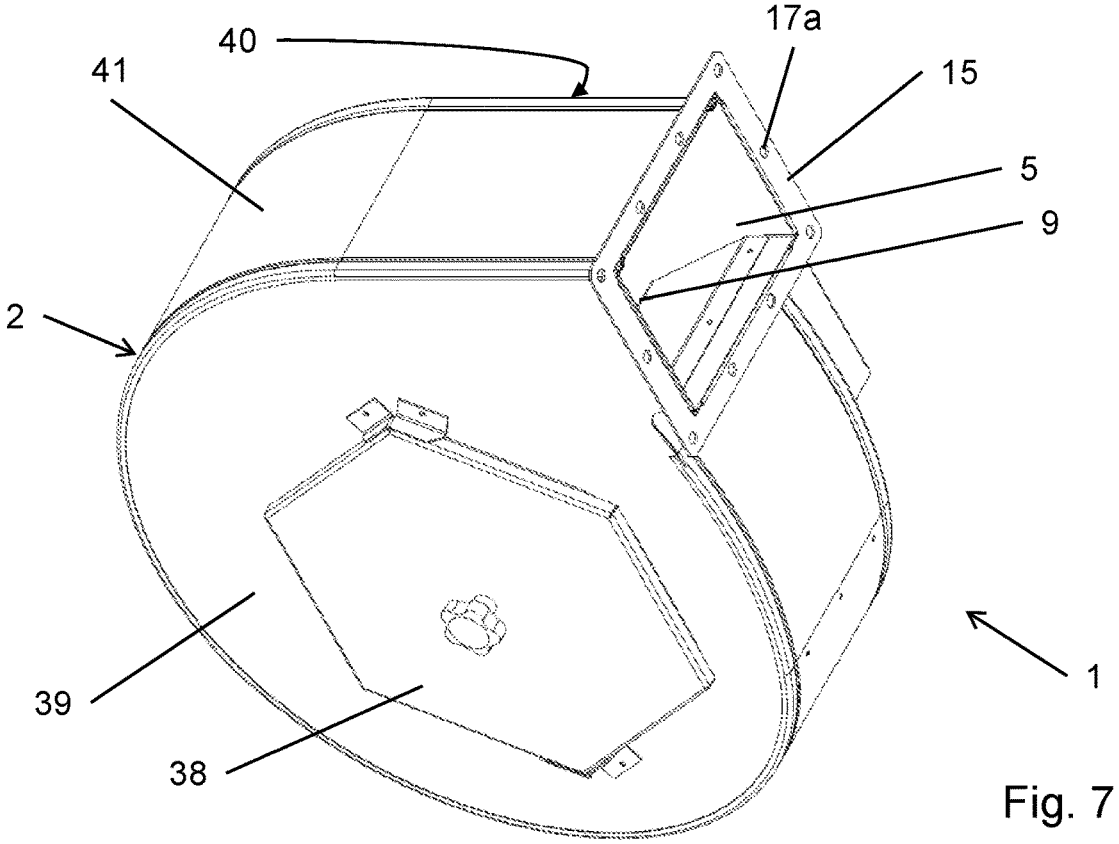
FIG. 7 shows a perspective view of a fan with a further embodiment of a spiral housing which is essentially made of sheet metal.

FIG. 7 shows a perspective view of a fan 1 with a further embodiment of a scroll housing 2 substantially made of sheet metal. The main components of the scroll housing 2 in the exemplary embodiment are a substantially planar lateral sheet metal 39 on the motor side, a substantially planar lateral sheet metal 40 on the nozzle side and a substantially unwindable circumferential lateral sheet metal 41, also referred to as scroll sheet metal 41, which has substantially, in a section on a planar perpendicular to the impeller axis, the inner contour 4 (see FIG. 9). In the exemplary embodiment, a maintenance lid 38 is also attached to the lateral sheet metal 39 on the motor side, facilitating access to the motor and the impeller. An inlet nozzle (not shown) is integrated on the lateral sheet metal 40 on the nozzle side, either in one piece or attached as a separate sheet metal or plastic part. The air outlet 5, which is square in the exemplary embodiment, is formed by the lateral sheet metals 39 to 41, a further sheet metal part being attached for additional reinforcement, functioning as a fastening flange 15, in which holes 17*a* are provided to simplify the fastening of the scroll housing 2 or the fan 1 to a superordinate system such as, for example, an air conditioning system or a flow channel.

Figure 8:
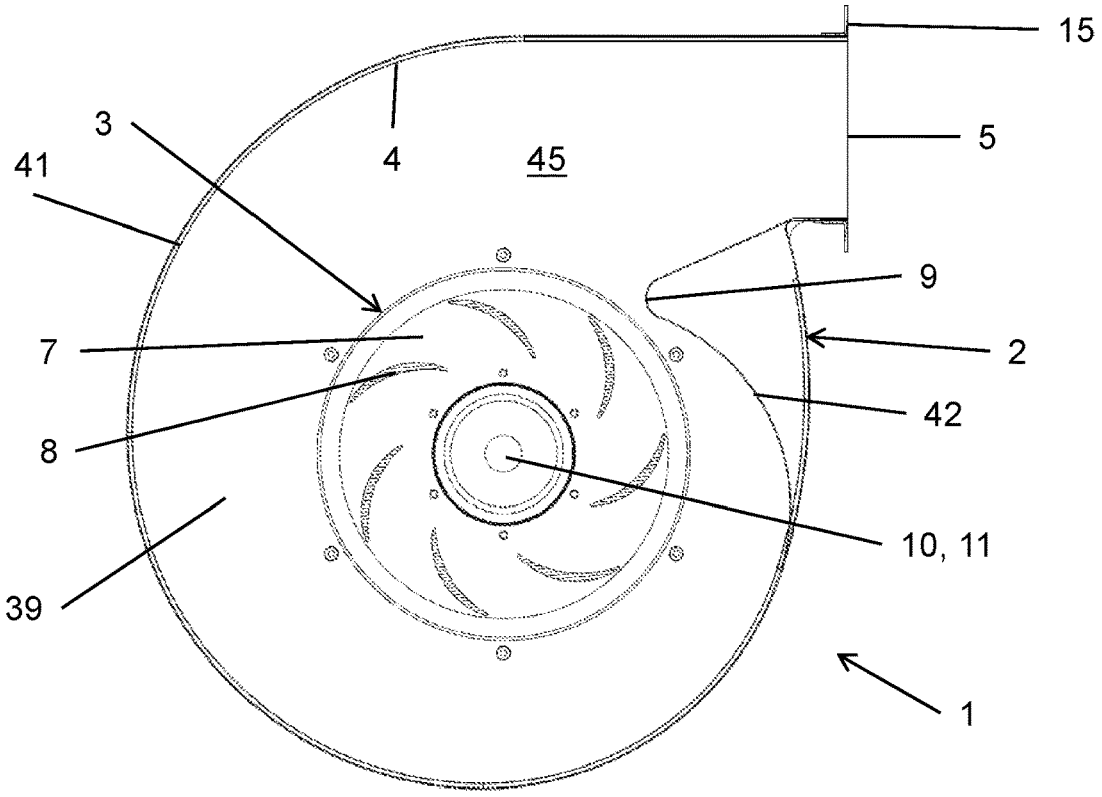
FIG. 8 shows the fan with the scroll housing according to FIG. 7 viewed in the direction of the impeller axis and in a section on a plane transverse to the impeller axis.

FIG. 8 shows a fan 1 with the scroll housing 2 according to FIG. 7 viewed in the direction of the impeller axis and in a section on a plane transverse to the impeller axis. The circumferential lateral sheet metal 41 having the inner contour 4 on the inner side at the edge of the flow channel 45 can be seen in section. The impeller 3, which is installed in the interior, is a backward-curved impeller with blades 8, a circular base 7 and a cover disc (not shown), the direction of rotation of which is clockwise in operation in the illustration shown. It is driven by a motor 10, the rotor 11 of which, to which the impeller 3 is attached, is visible inside the impeller 3. The outlet 5 is surrounded by a mounting flange 15 designed as a separate sheet metal part. In the embodiment, a special feature becomes visible here, which is related to the special design of the inner contour 4. Thus, the complete inner contour 4 having a special course with large curvatures in the vicinity of the tongue 9 is not depicted by the circumferential lateral sheet metal 41. A part of the inner contour 4 is represented by an additional inner tongue metal sheet 42, which can, for example, be made of thinner sheet thickness. Furthermore, the inner tongue metal sheet 42 can give the scroll housing 2 additional stability in conjunction with the side sheets 39 to 41.

Figure 9:
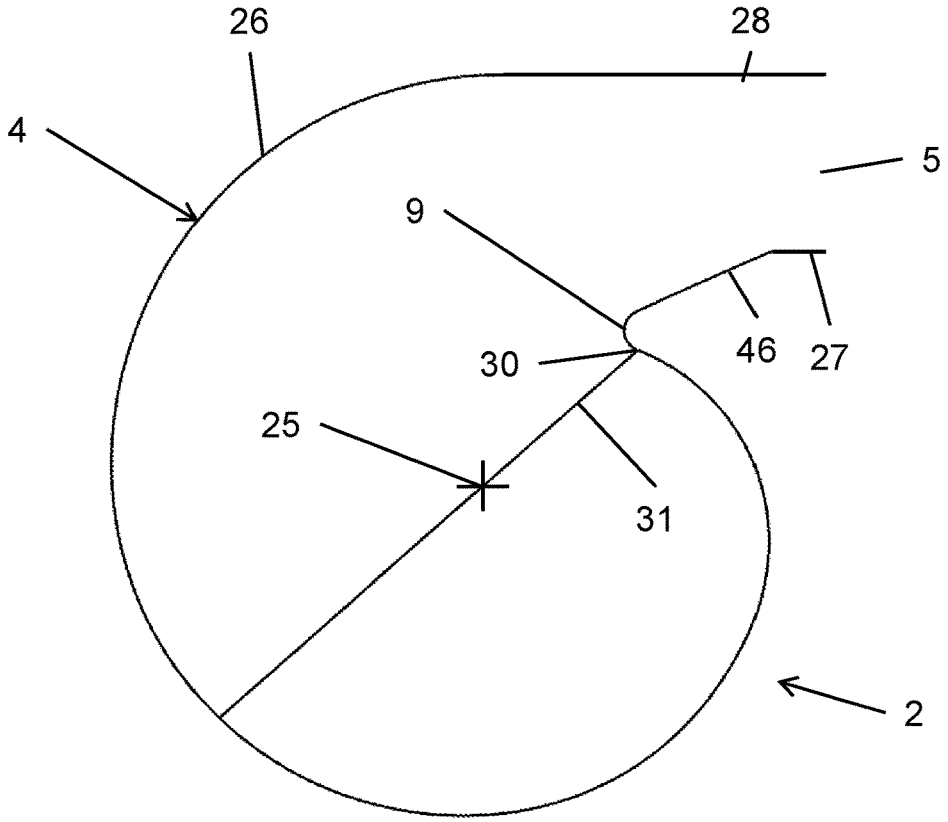
FIG. 9 shows the course of the spiral contour of the scroll housing in FIG. 7 and FIG. 8 in a schematic illustration with a viewing direction corresponding to that of FIG. 8, seen in a section transverse to the impeller axis.

FIG. 9 is a schematic illustration of the course of the inner contour 4 of the scroll housing 2 shown in FIG. 7 and FIG. 8 with a viewing direction corresponding to that of FIG. 8, viewed in a section transverse to the impeller axis. A representative section perpendicular to the impeller axis 25 is to be observed, for example at the point, viewed in the axial direction, at which the region enclosed by the inner contour 4 and the outlet 5 is at a maximum, or at the level of the center of the impeller outlet or approximately at the center of the flow channel 45. The inner contour 4 in the schematic illustration shown can be seen enclosing an outlet 5 at which the inner contour 4 is open. It can be subdivided into an outlet contour 27 on the tongue side, a tongue 9, a spiral contour 26 extending approximately around the impeller axis 25, an outlet contour 28 remote from the tongue, and a distinct transition contour 46 between the tongue 9 and the outlet contour 27. For the rest, reference is made, where necessary, to the explanations in FIGS. 3 to 6, which also apply here mutatis mutandis.

Figure 10:
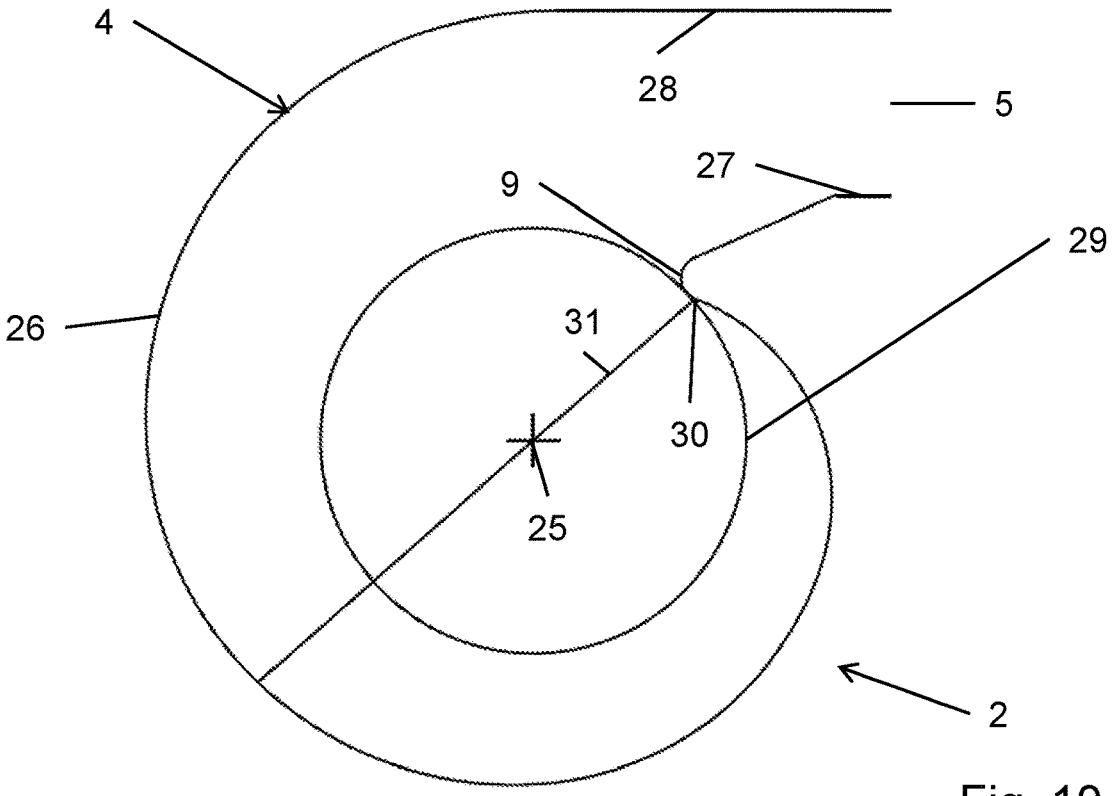
FIG. 10 shows the illustration according to FIG. 9, additionally plotting the largest inner circle coaxial to the impeller and the azimuthal position of the starting point of the spiral contour at the tongue.

FIG. 10 shows the illustration according to FIG. 9, the largest inner circle 29 coaxial to the impeller and the azimuthal position of the starting point 30 of the spiral contour 26 on the tongue 9 being additionally shown. Here, too, reference is made to the explanations in FIGS. 3 to 6, which also apply here mutatis mutandis.

To avoid repetition with regard to further embodiments of the teaching according to the disclosure, reference is made to the general part of the description and to the appended claims.

Finally, it should be expressly noted that the above-described exemplary embodiments of the teaching according to the disclosure merely serve to discuss the claimed teaching, but do not restrict it to the exemplary embodiments.

LIST OF REFERENCE SIGNS

1 Fan
2 Scroll housing, housing
2*a* Nozzle-side half of the scroll housing/housing
2*b* Motor-side half of the scroll housing/housing
3 Impeller
4 Inner contour/spiral contour
5 Outlet
6 Transitional region
7 Circular base of the impeller
8 Impeller blades
9 Tongue
10 Motor
11 Motor rotor
12 Motor stator
13 Circular sheet metal blank
14 Inlet nozzle
15 Mounting flange
16 Connecting region
17*a*, Holes
17*b* Holes
18 Stiffening element, stiffening rib
19 Motor rotor
20 Motor stator
21 not used
22 not used
23 Connecting region between the housing halves
24 Inflow area
25 Impeller axis
26 Spiral contour, contour
27 Tounge-side outlet contour
28 Outlet contour remote from the tongue
29 Largest inner circle coaxial to the impeller
30 Starting point of the spiral contour
31 0°-beam, reference beam for azimuthal angle determination
32 Smallest circle of curvature of the spiral contour, circle of curvature at the starting point of the spiral contour
33 Maximum radius of the impeller
34 Circle coaxial to the impeller and through a point P on the inner contour
35 Point P on the inner contour
36 Azimuthal angle θ of the inner contour
37 Pitch angle α of the inner contour at a point P
38 Maintenance lid, inspection opening
39 Lateral sheet metal on the motor side
40 Lateral sheet metal on the nozzle side
41 Circumferential lateral sheet metal, scroll sheet metal
42 Inner tongue metal sheet
43 Blade suction side
44 Blade pressure side
45 Flow channel in the scroll housing
46 Transition contour

The invention claimed is:

1. A fan, comprising:
an impeller having backward-curved blades;
a scroll housing and
a flow channel of which is formed by an inner contour of the housing, depicting a spiral contour, the flow channel guiding the air conveyed by the impeller towards an outlet,
wherein an average pitch angle of the spiral contour is more than twice as high in a sector range with an azimuthal angle θ from θ=0° to θ=45°, measured from near or at the tongue of the housing, as in a sector range with an azimuthal angle θ from θ=45° to θ=180°, measured from near or at the tongue.

2. The fan of claim 1, wherein local pitch angle of the spiral contour starts from a narrowest region in the flow channel, near or at a tongue, in the direction of rotation of the impeller, and has a greater value than in the further course up to an outlet with an outlet contour remote from the tongue.

3. The fan of claim 2, wherein the local pitch angle in the circumferential direction decreases again to lower values.

4. The fan of claim 2, wherein local pitch angles over a sector range of 24° to 55°, starting at the narrowest region or at the tongue, have a higher pitch angle than local pitch angles in the further course.

5. The fan of claim 2, wherein the starting point of the spiral contour near the tongue is defined as that point on the inner contour of the housing, which is closest to the impeller axis, or at which, moving from the tongue in the direction of rotation of the impeller, the curvature of the inner contour reverses its sign.

6. The fan of claim 2, wherein the radius of the circle of curvature at the starting point of the spiral contour, in the narrowest region of the flow channel or at the tongue, is smaller compared to the course of the radius of the circle of curvature over a majority of the course of the spiral contour, the radius of the circle of curvature of the spiral contour at the starting point of the spiral contour being a minimum radius of the circle of curvature.

7. The fan of claim 1, wherein the radius of the circle of curvature at the starting point of the spiral contour is smaller than the maximum radius of the impeller.

8. The fan of claim 2, wherein a distance between a maximum radius of the impeller or the blades of the impeller and the tongue of the housing is at least 6% of the maximum radius of the impeller or the blades of the impeller.

9. The fan of claim 1, wherein the scroll housing consists of two housing halves, one housing half on an inflow nozzle side comprising an inflow nozzle and an inflow area located upstream of the inlet nozzle with a larger outer radius than the inlet nozzle, and one housing half on a motor side comprising fastening means for a motor.

10. The fan of claim 9, wherein the two housing halves have a flange-like connecting region as an outer edge region, at or in which the housing halves are mutually connected by means of screws, clips, rivets, or adhesive technology.

11. The fan of claim 1, wherein the scroll housing comprises a substantially flat or planar lateral part on a motor-side, a substantially flat or planar lateral part on an inlet nozzle side, and a unwindable peripheral part.

12. The fan of claim 9, wherein the motor-side housing half has an inspection opening with a lid.

13. The fan of claim 9, wherein the housing halves are made from injection-molded plastic or sheet metal.

14. The fan of claim 1, wherein the scroll housing has a fastening flange in the region of the outlet for fastening the fan to a structure, the fastening flange being a component of housing halves or a separate housing half.

15. The fan of claim 11, wherein the motor-side lateral part has an inspection opening with a lid.

16. The fan of claim 1, wherein a distance r of the spiral contour has the smallest value at a starting point of the spiral contour near or at a tongue of the housing and increases at least by 1.47 times in the course of the spiral contour at least up to an azimuthal angle $\theta=180°$.

* * * * *